US010265761B2

(12) United States Patent
Werner

(10) Patent No.: US 10,265,761 B2
(45) Date of Patent: Apr. 23, 2019

(54) CASTING DEVICE AND DIECASTING METHOD

(71) Applicant: KSM Castings Group GmbH, Hildesheim (DE)

(72) Inventor: Michael Werner, Hildesheim (DE)

(73) Assignee: KSM Castings Group GmbH, Hildesheim (DE)

( * ) Notice: Subject to any disclaimer, the term of this patent is extended or adjusted under 35 U.S.C. 154(b) by 61 days.

(21) Appl. No.: 15/301,994

(22) PCT Filed: Mar. 24, 2015

(86) PCT No.: PCT/DE2015/100123

§ 371 (c)(1),
(2) Date: Oct. 5, 2016

(87) PCT Pub. No.: WO2015/185031

PCT Pub. Date: Dec. 10, 2015

(65) Prior Publication Data

US 2017/0136530 A1 May 18, 2017

(30) Foreign Application Priority Data

Jun. 2, 2014 (DE) ..... 10 2014 107 715

(51) Int. Cl.
*B22D 17/20* (2006.01)
*B22D 17/30* (2006.01)
(Continued)

(52) U.S. Cl.
CPC ..... *B22D 17/145* (2013.01); *B22D 17/08* (2013.01); *B22D 17/14* (2013.01); *B22D 17/203* (2013.01); *B22D 17/2023* (2013.01); *B22D 17/30* (2013.01)

(58) Field of Classification Search
CPC . B22D 17/2015; B22D 17/2023; B22D 17/30
(Continued)

(56) References Cited

U.S. PATENT DOCUMENTS 5,195,572 A * 3/1993 Linden, Jr. ..... B22D 17/2023 164/312
5,199,480 A * 4/1993 Schultz ..... B22D 17/2015 164/113
(Continued)

FOREIGN PATENT DOCUMENTS

DE 199 02 063 A1 7/2000
DE 10 2004 057 324 A1 6/2006
(Continued)

OTHER PUBLICATIONS

International Search Report of PCT/DE2015/100123, dated Sep. 7, 2015.

*Primary Examiner* — Kevin E Yoon
(74) *Attorney, Agent, or Firm* — Collard & Roe, P.C.

(57) ABSTRACT

A casting device and a diecasting method, preferably a vacuum die-casting method, includes a casting chamber having a filling opening, and a casting piston that can be moved in the casting chamber and is connected with a casting drive by way of a casting piston rod. The device also includes a feed line, by way of which casting material can be filled into the casting chamber through the filling opening. The casting chamber is disposed, at least in part, in a sleeve that is mounted so as to rotate.

11 Claims, 5 Drawing Sheets

Figure 1:
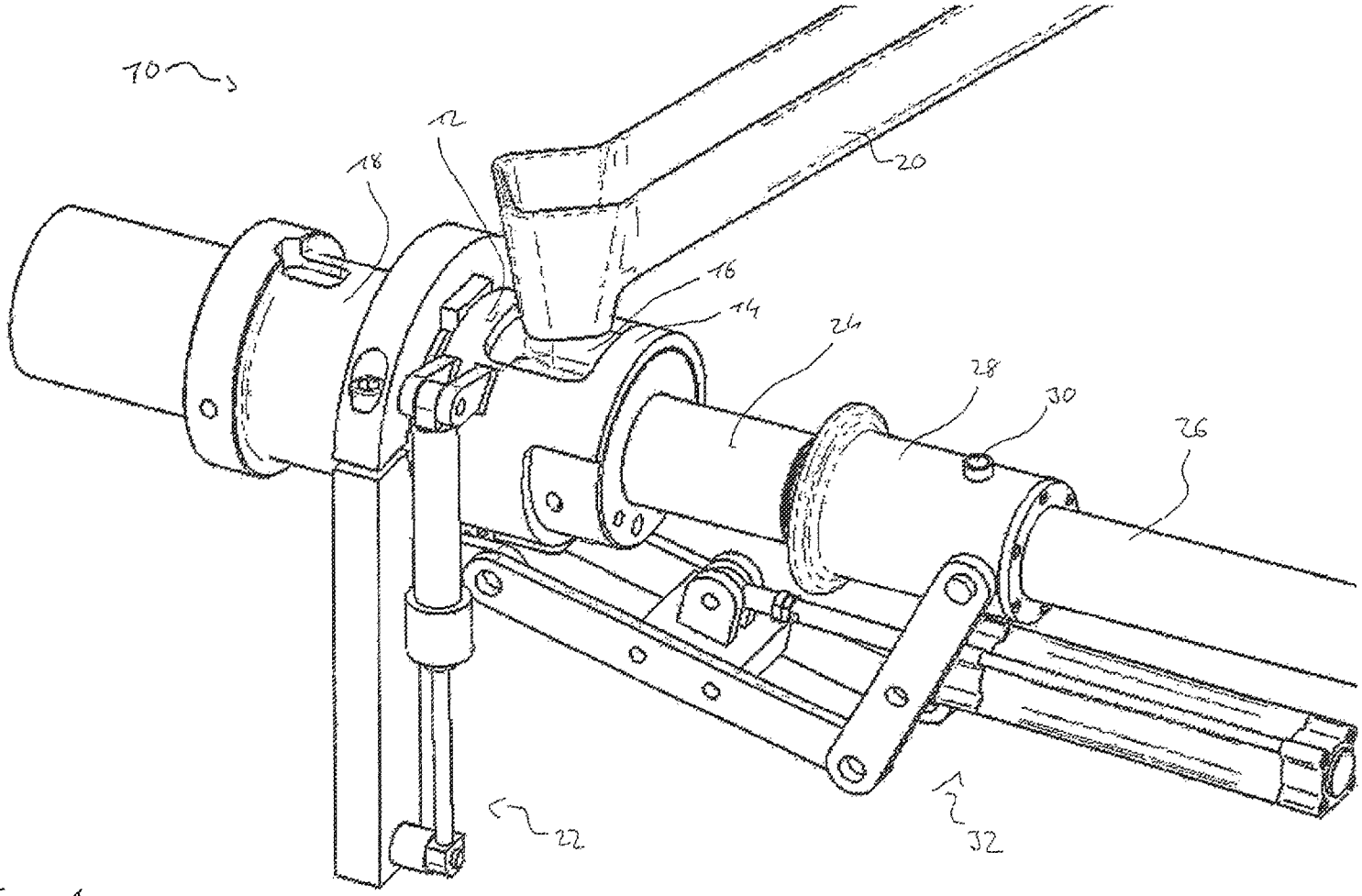

(51) Int. Cl.
*B22D 17/14* (2006.01)
*B22D 17/08* (2006.01)

(58) Field of Classification Search
USPC ..... 164/113, 303–318
See application file for complete search history.

(56) References Cited

U.S. PATENT DOCUMENTS

| | | | | |
|---|---|---|---|---|
| 5,284,201 | A | 2/1994 | Hegel et al. | |
| 2007/0074842 | A1 | 4/2007 | Manoff | |
| 2009/0050289 | A1 | 2/2009 | Lismont | |
| 2011/0180228 | A1* | 7/2011 | Sakai ..... | B22D 17/30 164/80 |

FOREIGN PATENT DOCUMENTS

| | | | |
|---|---|---|---|
| EP | 0 694 357 | A1 | 1/1996 |
| JP | S59 107759 | A | 6/1984 |

* cited by examiner

CASTING DEVICE AND DIECASTING METHOD

CROSS REFERENCE TO RELATED APPLICATIONS

This application is the National Stage of PCT/DE2015/100123 filed on Mar. 24, 2015, which claims priority under 35 U.S.C. § 119 of German Application No. 10 2014 107 715.6 filed on Jun. 2, 2014, the disclosure of which is incorporated by reference. The international application under PCT article 21(2) was not published in English.

The invention relates to a casting apparatus and to a die-casting method.

Casting apparatuses for use in die-casting methods and vacuum die-casting methods, as well as the corresponding methods, have been known for some time. In vacuum die-casting, it is known that a partial vacuum or vacuum is generated in the mold cavity of the casting mold, as well as in the casting chamber, after the casting chamber has been filled with casting material and the casting piston has moved past the filling opening of the casting chamber.

Such vacuum die-casting methods are used for the production of cast pieces made of metals and metal alloys, particularly of alloys of the metals Al, Mg, Zn, and Cu. The advantage of the vacuum die-casting method consists in that a qualitatively high-quality grade of the cast parts can be achieved by means of the reduced influence of air and gases in the casting material. This particularly holds true for cast pieces made of aluminum or an aluminum alloy, which might still be supposed to be subjected to heat treatment and/or welded daring a later process procedure.

In the simplest form of vacuum die-casting, the partial vacuum or the vacuum is generated by way of a ventilation valve attached to the casting mold or the casting chamber. Only after the casting chamber was filled with casting material and the casting piston has moved past the filling opening of the casting chamber in a first method step, and thereby the connection to the outside atmosphere has been interrupted, can the casting mold be brought to partial vacuum. It is a disadvantage of this method of procedure that the method of the casting piston for closing off the filling opening of the casting chamber is a comparatively lengthy process, and that the process time remaining after the piston has moved past the filling opening is generally not sufficient to evacuate the casting chamber to a sufficient degree. Furthermore, the partial vacuum to be achieved is further worsened by the tight cross-sections of the ventilation valve.

In order to circumvent this problem, it would be possible to introduce a further method step after the filling opening of the casting chamber has been closed off by the casting piston, in which step the casting piston does not chancre its position during the evacuation process of the casting chamber. However, it is a disadvantage of such an intermediate step that the process time, which has been lengthened as a whole, cools off the casting material in the casting chamber, which therefore loses its ideal casting temperature.

A further development of a vacuum die-casting apparatus that is already known provides that the filling opening of the casting chamber is closed off by means of a hood and not by means of the casting piston. A corresponding system for vacuum die-casting is described, for example, in DS 10 2004 057 324 A1.

The method described in DE 10 2004 057 324 A1 provides that after the casting material has been introduced into the casting chamber and the casting chamber has been closed off by means of a hood, the casting chamber is evacuated. By means of this method of procedure, it is possible to circumvent the lengthy first process step of closing off the filling opening of the casting chamber by means of the casting piston. Subsequent to generation of the partial vacuum or the vacuum, the casting piston can bring the casting material into the casting mold at a speed that is increased right from the start, thereby reducing the process time of the actual die-casting process.

It is a disadvantage of the hood described in DE 10 2004 057 324 A1 for closing off the filling opening of the casting chamber that in order to be able to close off the filling opening with the hood, first the feed line has to be removed from the filling opening during an upstream process step.

The present invention is therefore based on the task of eliminating the stated problems when generating a partial vacuum or vacuum in a casting chamber, and, in particular, of accelerating the cycle time during vacuum die-casting and thereby increasing the production output. A further task of the invention consists in improving the tightness of a vacuum die-casting apparatus in such a manner that a higher partial vacuum or vacuum can be set in the casting chamber and consequently also in the rest of the system.

This task is accomplished, in the case of a casting apparatus by means of the present invention and, in the case of a die-casting method, by means of the present invention. Further developments and advantageous embodiments are evident from the following description.

The casting apparatus according to the invention, which is particularly suitable for a die-casting method, preferably for a vacuum die-casting method, and comprises a casting chamber having a filling opening, a casting piston that can be moved in the casting chamber, which piston is connected with or can be moved by a casting drive, by way of a casting piston rod, in its back space, and having a feed line, by way of which casting material can be filled into the casting chamber through the filling opening, is characterized in that the casting chamber is disposed, at least in part, in a sleeve that is mounted so as to rotate. By means of such a rotatable sleeve, which can preferably close off the filling opening of the casting chamber, the result is achieved that casting material that has dripped onto the outside wall of the casting chamber during the filling process is sheared off from the wall, and the filling opening of the casting chamber can be sealed off from the atmosphere, to the greatest possible extent.

In this regard, it can be advantageous if the sleeve has an opening that can be positioned over the filling opening of the casting chamber, at least in part, by means of a rotation of the sleeve.

For a rotation of the sleeve, it can be advantageous if the casting chamber is configured to be round in cross-section, at least in this region.

It can be advantageous if the opening of the sleeve is such that it corresponds to the filling opening of the casting chamber in shape and size, at least to the greatest possible extent.

It can be practical if the opening of the sleeve, in a filling position, can be positioned above the filling opening of the casting chamber, to the greatest possible extent. In this position, it is possible to introduce or fill casting material into the casting chamber by way of the feed line, particularly by way of a casting channel.

By means of a rotation of the sleeve, it is possible to close off the filling opening of the casting chamber by means of the wall of the sleeve. It can be advantageous if, for this purpose, predetermined regions of the sleeve and/or of the outer mantle of the casting chamber are configured in such a manner that they ensure the greatest possible tightness between sleeve and casting chamber around the filling opening of the casting chamber, in order to thereby improve setting a partial vacuum within the casting chamber. To achieve tightness, it is possible to make use of the neat expansion behavior of casting chamber and/or sleeve, for example.

It can be advantageous if the sleeve can be rotated about the longitudinal axis of the casting chamber by means of a rotation apparatus.

During filling of the casting chamber with casting material, it can happen that casting material is not introduced into the casting chamber, but rather partially drips onto the outside wall of the casting chamber. By means of the use of a rotation apparatus, particularly a hydraulically or pneumatically driven rotation apparatus, it is possible to rotate the sleeve about the casting chamber in such a manner that casting material that might have dripped onto the outside wall of the casting chamber is sheared off from the outside wall of the casting chamber by the sleeve. In this way, it is possible that even, in the event that casting material has dripped onto the outside wall of the casting chamber, the chamber can still be tightly sealed.

The force that can be generated with such a drive speaks in favor of the use of a pneumatically or hydraulically driven rotation apparatus. It is advantageous if the force that moves the sleeve is selected to be so great that reliable shearing off of casting material that might have dripped onto the outside wall of the casting chamber is guaranteed.

It can be practical if the sleeve and/or the feed line is/are configured in such a manner that they stand in an active connection with one another. Moving of the sleeve can preferably bring about moving of the feed line at the same time. In this way, the cycle time can be shortened.

It can be particularly advantageous if the active connection is such that when the sleeve is rotated, both the sleeve and the feed line can be moved out of a and/or into the filling position, preferably in such a manner that the feed line can be mechanically lifted out of the opening or filling opening or lowered into the opening or filling opening, at least in part, when the sleeve is rotated. In this regard, it is advantageous if the sleeve and/or the feed line be configured in the manner of a slanted plane at a suitable location, so that sleeve and feed line slide on one another, at least in part.

It can be advantageous if the sleeve has an exhaust opening.

On the basis of the exhaust opening in the sleeve, it is possible to evacuate the casting chamber by way of the filling opening of the casting chamber. Evacuation of the casting chamber by way of the filling opening of the casting chamber has the advantage that lines having a very much greater diameter than was the case in the state of the art can be used for the evacuation. The use of lines having the greatest possible diameter for evacuation of the casting chamber allows time-saving evacuation of the casting chamber.

It can be advantageous if the exhaust opening is disposed on the sleeve in such a manner that the opening can be positioned above the filling opening of the casting chamber, at least in part, by means of a rotation of the sleeve.

In that the exhaust opening is disposed on the sleeve in such a manner that the exhaust opening is situated above the filling opening of the casting chamber in the casting position of the sleeve, it is possible to automatically position the exhaust opening above the filling opening of the casting chamber, at least in part, as the sleeve is moved from a filling position into the casting position.

Consequently, two method steps, namely closing off the casting chamber and positioning an exhaust opening above the filling opening of the casting chamber, can be implemented in only one method step. Such combining of two method steps in one makes it possible to shorten the time of the method as a whole.

It can be practical if the sleeve has a lifting element.

A lifting element according to the invention makes it possible to remove the feed line, by way of which the casting material is introduced into the casting chamber, from the filling opening of the casting chamber, after the casting material has been introduced into the casting chamber, in such a manner that the sleeve can be brought from the filling position to the casting position.

A lifting element according to the invention can also make it possible to move the sleeve from the filling position into the casting position in such a manner that the feed line, by way of which the casting material is introduced into the casting chamber, is removed from the filling opening of the casting chamber after the casting material has been introduced into the casting chamber. In that the lifting element according to the invention is disposed on the outside wall of the sleeve, it is possible to connect the feed line with the sleeve, by means of the lifting element, in such a manner that the feed line can be removed from the filling opening of the casting chamber simultaneously with the rotation of the sleeve, by means of the rotation of the sleeve about the longitudinal axis of the casting chamber.

Such an embodiment makes it possible to implement the method steps of removing the feed line and closing the casting chamber, as described in the state of the art, in only one method step. Such combining of two method steps in one makes it possible to shorten the time of the method as a whole.

It can be advantageous if the casting piston rod is disposed, at least in part, in a closure element that is ring-shaped, to the greatest possible extent, which element is mounted so as to be displaceable along the longitudinal axis of the casting chamber.

In order to be able to generate the smallest possible partial vacuum or a vacuum within the casting chamber, it can be necessary to close off any leakages that might be present, as tightly as possible. In this regard, the ring gap between the inside wall of the casting chamber and the outer mantle of the casting piston is an extremely important leakage. Gases can penetrate into the casting chamber at this leakage, from the back side of the casting piston, during the process of evacuation of the casting chamber. These penetrating gases can lead to veritable foaming of the casting material in the casting chamber, and can thereby generate gas porosity in the cast part, which porosity minimizes or actually excludes heat treatment and weldability of the cast part.

In order to prevent penetration of gases through the ring gap between the inside wall of the casting chamber and the outer mantle of the casting piston, it can be advantageous to dispose a closure element, which is ring-shaped to the greatest possible extent, at the back side of the casting chamber, in such a manner that the ring gap between the inside wall of the casting chamber and the outer mantle of the casting piston can be tightly closed.

The closure element can be configured in such a manner that it tightly closes off the ring gap between the inside wall of the casting chamber and the outer mantle of the casting piston, and, in this regard, does not impair the function of the casting piston or of the casting piston rod.

It can be advantageous if the closure element, which is ring-shaped to the greatest possible extent, can be disposed at the back side of the casting chamber by means of a pushing apparatus, particularly a pneumatically or hydraulically driven pushing apparatus.

On the basis of the hot casting material filled into the casting chamber, the components expand. In order to produce a tight connection between the closure element and the back side of the casting chamber in spite of the expansion of the component, it can be necessary to dispose the closure element on the back side of the casting chamber with a sufficiently great press-down pressure. Such advantageous press-down pressures can be generated, for example, by means of a pneumatically or hydraulically driven pushing apparatus.

It can be practical if the closure element has an exhaust apparatus.

If the closure element spans a cavity with the back side of the casting chamber, the surface of the casting piston rod, and the inside of the closure element, it can be advantageous if the closure element has an exhaust opening by way of which the space spanned by the back side of the casting chamber, the surface of a casting piston rod, and the inside of the closure element can be evacuated. By means of the placement of a separate exhaust opening in the closure element, it is possible to already begin evacuation of the space spanned by the back side of the casting chamber, the surface of the casting piston rod, and the inside of the closure element, even before the filling procedure of the casting material into the casting chamber has been completed. If the casting mold is already supposed to be evacuated during the filling procedure of the casting material into the casting chamber, by way of a separate exhaust opening, the volume within the casting chamber to be evacuated is reduced to a minimum by means of the exhaust opening in the closure element and the evacuation of the back space of the casting chamber described above. Evacuation of the casting mold and of the back space of the casting chamber that has already been carried out during the filling process of the casting material into the casting chamber makes it possible to shorten the time of the method as a whole.

The die-casting method, particularly vacuum, die-casting method, according to the invention comprises the following method steps:

a) moving a sleeve to a filling position,
b) positioning a feed line above a filling opening,
c) introducing a casting material into a casting chamber,
d) moving the feed line,
e) rotating the sleeve about a longitudinal axis of the casting chamber, into a casting position,
f) introducing the casting material into a casting mold by means of a casting piston.

On the basis of the rotation of the sleeve and the accompanying closing off of the filling opening of the casting chamber, it is possible to shear off casting material that has dripped onto the outside wall of the casting chamber during the filling procedure from this wall, and to tightly close off the filling opening of the casting chamber relative to the atmosphere.

It can be advantageous if moving the sleeve into the filling position takes place in such a manner that an opening of the sleeve is positioned above a filling opening of a casting chamber, at least in part.

It can be advantageous if, after rotation of the sleeve into the casting position and before the casting piston introduces the casting material into the casting mold, the casting chamber is evacuated, at least in part, by way of an exhaust opening disposed in the sleeve.

On the basis of the at least partial evacuation of the casting chamber, it is possible to reduce the proportion of gases in the casting material and the subsequent cast part. Evacuation of the casting chamber by way of an exhaust opening disposed in the sleeve allows the use of lines having a very much greater diameter than was the case in the state of the art. The use of lines having the greatest possible cross-section for evacuation of the casting chamber allows time-saving evacuation of the casting chamber.

It can be practical if a closure element is positioned at a back side of the casting chamber before, while or after the sleeve is moved into the casting position.

In order to be able to generate the lowest possible partial vacuum or a vacuum within the casting chamber, it can be necessary to close off any leakages that might be present, as tightly as possible. In this regard, an extraordinarily important leakage is the ring gap between the inside wall of the casting chamber and the outer mantle of the casting piston. Gases can penetrate into the casting chamber at this leakage, from the rear side of the casting piston, during the process of evacuation of the casting chamber. These penetrating gases lead to veritable foaming of the casting material in the casting chamber, and can thereby generate gas porosity in the cast part, which porosity minimizes or actually excludes heat treatment and weldability of the cast part.

In order to prevent penetration of gases through the ring gap between the inside wall of the casting chamber and the outer mantle of the casting piston, it can be advantageous to dispose a closure element, which is ring-shaped to the greatest possible extent, at the back side of the casting chamber, in such a manner that the ring gap between the inside wall of the casting chamber and the outer mantle of the casting piston is tightly closed off.

It is advantageous that the closure element can foe disposed around the casting piston rod, at least in part, in such a manner that the closure element can be displaced along the longitudinal axis of the casting chamber.

Before, while or after the casting chamber is filled with casting material, the closure element can move along the longitudinal axis of the casting chamber at the back side of the casting chamber. Depending on the process management, it is therefore possible to evacuate the space that is spanned by the back side of the casting chamber, the surface of a casting piston rod, and the inside of the closure element, before, while or after the casting chamber is filled with casting material.

Consequently, it can be possible to reduce the total time for the casting method by means of a corresponding determination of the point in time, which depends on the casting method and the cast part to be produced, in each instance, for evacuation of the space spanned by the back side of the casting chamber, the surface of a casting piston rod, and the inside of the closure element.

It can be advantageous if the space that is spanned by the back side of the casting chamber, the surface of a casting piston rod, and the inside of the closure element, is evacuated, at least in part, by way of an exhaust opening, after the closure element is moved to the back side of the casting chamber and before the casting piston introduces the casting material into the casting mold.

If the closure element were to span a cavity with the back side of the casting chamber, the surface of a casting piston rod, and the inside of the closure element, it can be advantageous if the closure element has an exhaust opening by way of which the space spanned by the back side of the casting chamber, the surface of a casting piston rod, and the inside of the closure element can be evacuated. By means of the placement of a separate exhaust opening in the closure element, it is possible to already begin the evacuation of the space spanned by the back side of the casting chamber, the surface of the casting piston rod, and the inside of the closure element even before the filling procedure of the casting material into the casting chamber has been completed. If the casting mold is already supposed to be evacuated during the filling procedure of the casting material into the casting chamber, by way of a separate exhaust opening, the volume within, the casting chamber, which volume is to be evacuated, is reduced to a minimum by means of the exhaust opening in the closure element and the evacuation of the back space of the casting chamber as described above. Any evacuation of the casting mold and of the back space of the casting chamber that has already been carried out during the filling process of the casting material into the casting chamber makes it possible to reduce the time of the method as a whole.

It can be advantageous if, after the casting chamber has been filled with casting material, the feed line is moved simultaneously with the rotation of the sleeve, by means of a lifting apparatus that is disposed on the sleeve.

A lifting element according to the invention makes it possible to remove the feed line by way of which the casting material is introduced into the casting chamber, after the casting material, has been introduced into the casting chamber, from the filling opening of the casting chamber, in such a manner that the sleeve can be moved from the filling position into the casting position.

In that the lifting element according to the invention is disposed on the outside wall, of the sleeve, it is possible to connect the feed line with, the sleeve, by means of the lifting element, in such a manner that the feed line is removed from the filling opening of the casting chamber simultaneously with the rotation of the sleeve, by means of the rotation of the sleeve about the longitudinal axis of the casting chamber.

Such an embodiment makes it possible to implement the method steps of removing the feed line and of closing off the casting chamber, as described in the state of the art, in only one method step, at the same time. Such combining of two method steps into one makes it possible to shorten the time of the method as a whole.

It can be practical if the feed line is automatically positioned above the filling opening with the rotation of the sleeve from the casting position into the filling position.

In that the lifting element according to the invention is disposed on the outside wall of the sleeve, it is possible to connect the feed line with the sleeve, by means of the lifting element, in such a manner that the feed line is positioned above or in the filling opening of the casting chamber, by means of the rotation of the sleeve about the longitudinal axis of the casting chamber, simultaneously with the rotation of the sleeve.

Such an embodiment makes it possible to implement the method steps described in the prior art, of opening the casting chamber and positioning the feed line above or in the filling openings, which are disposed to cover one another, at least in part, simultaneously in only one method step. Such combining of two method steps into one makes it possible to shorten the time of the method as a whole.

Figure 2:
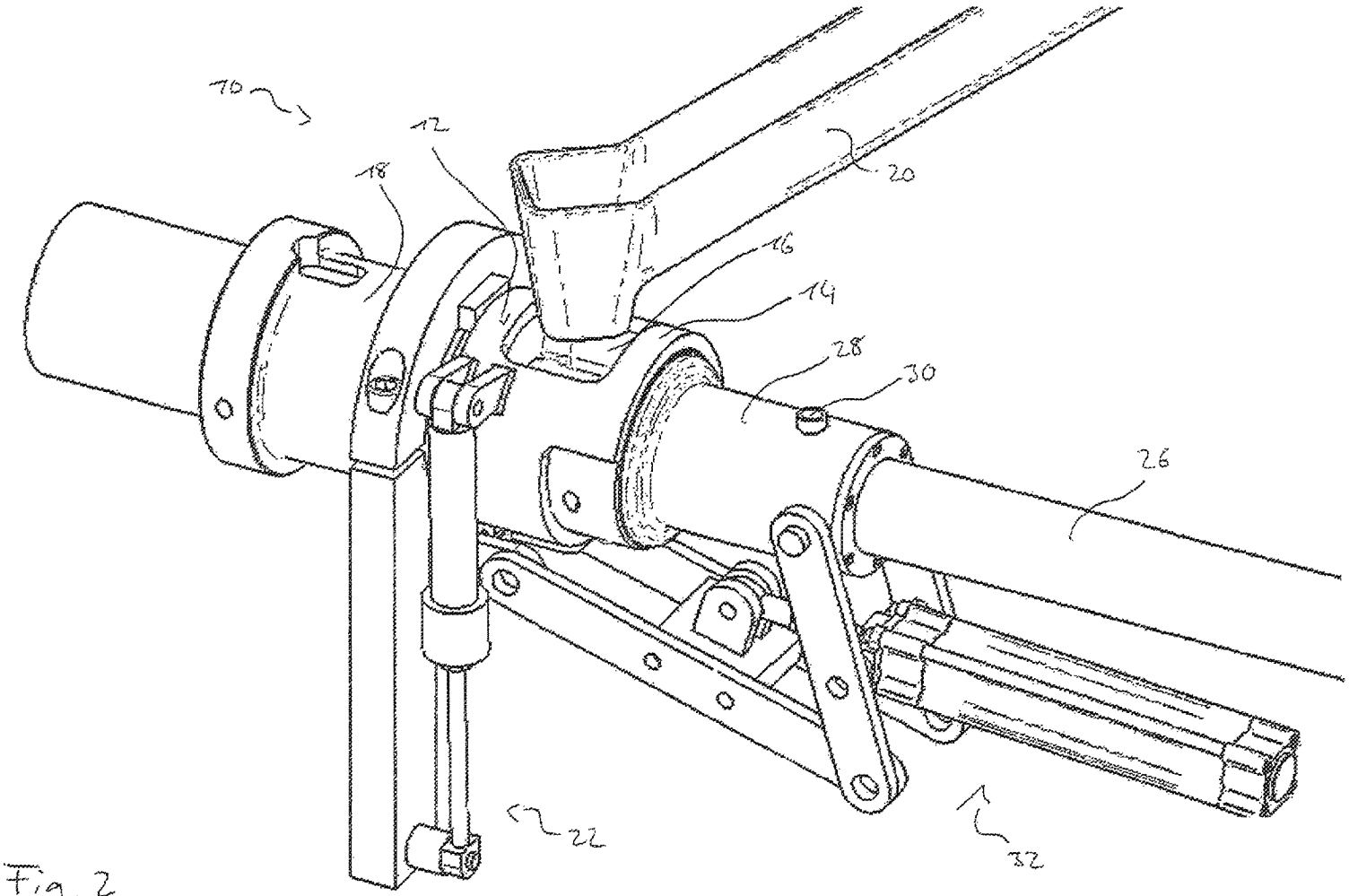
Figure 3:
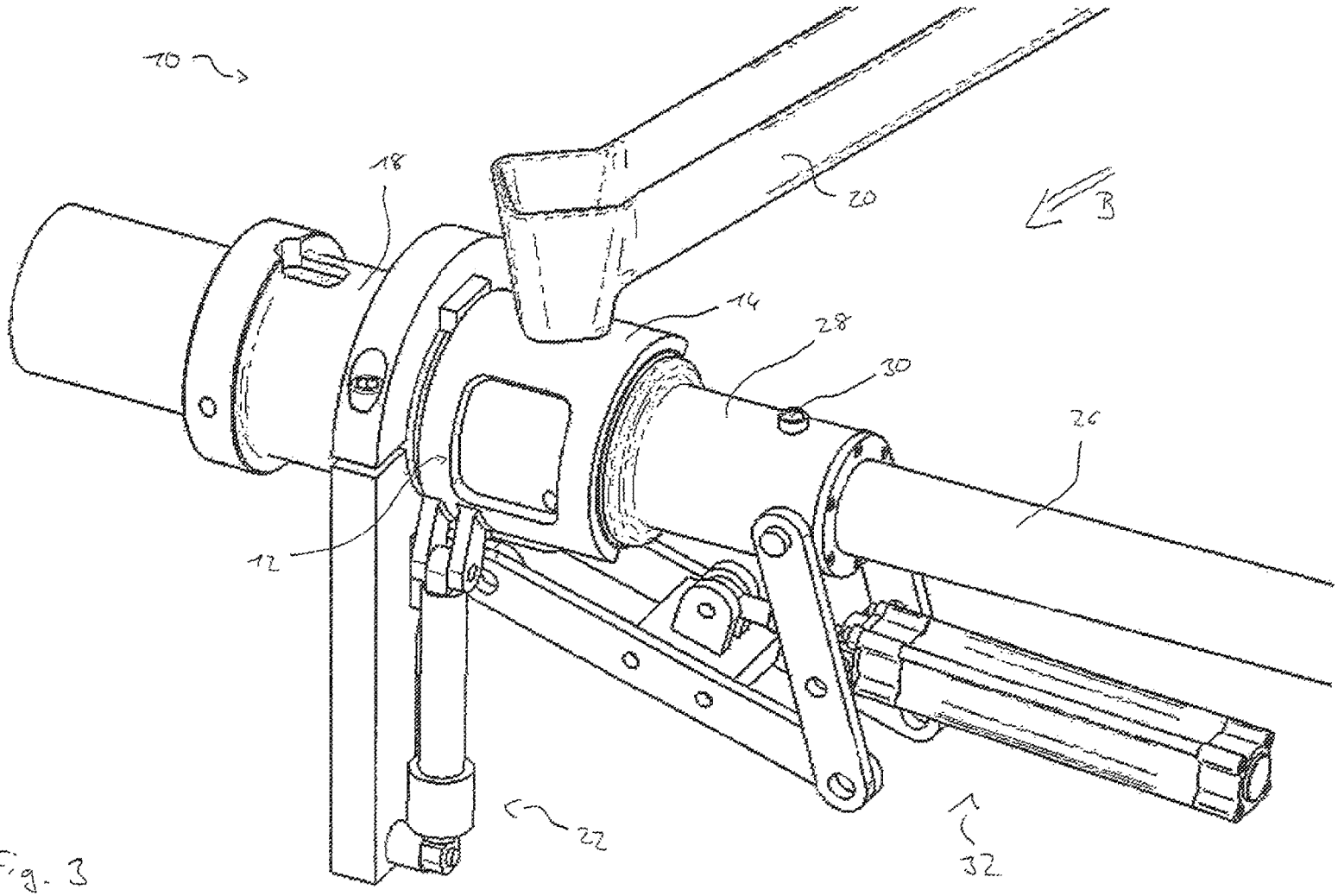
Figure 4:
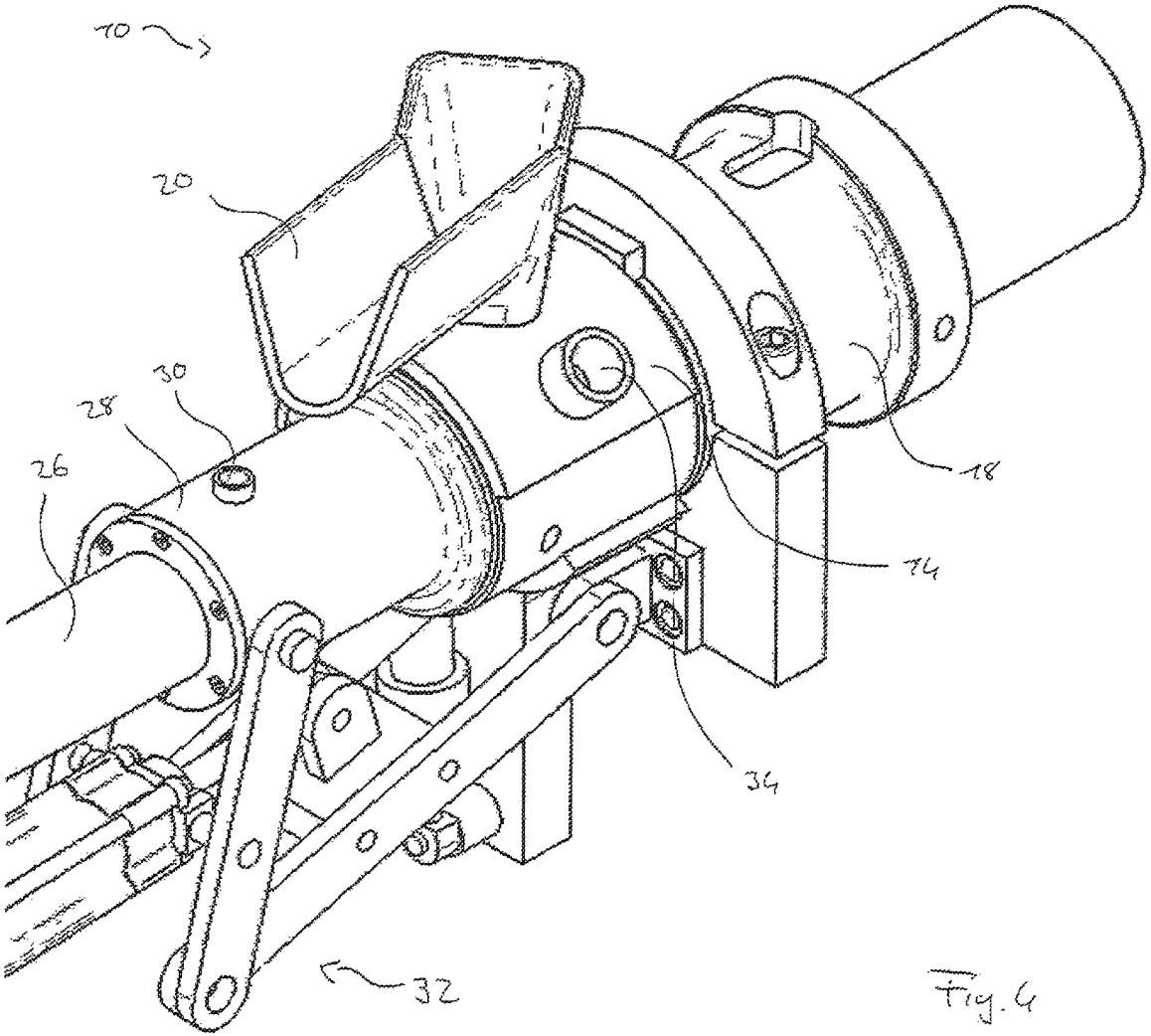
Figure 4:
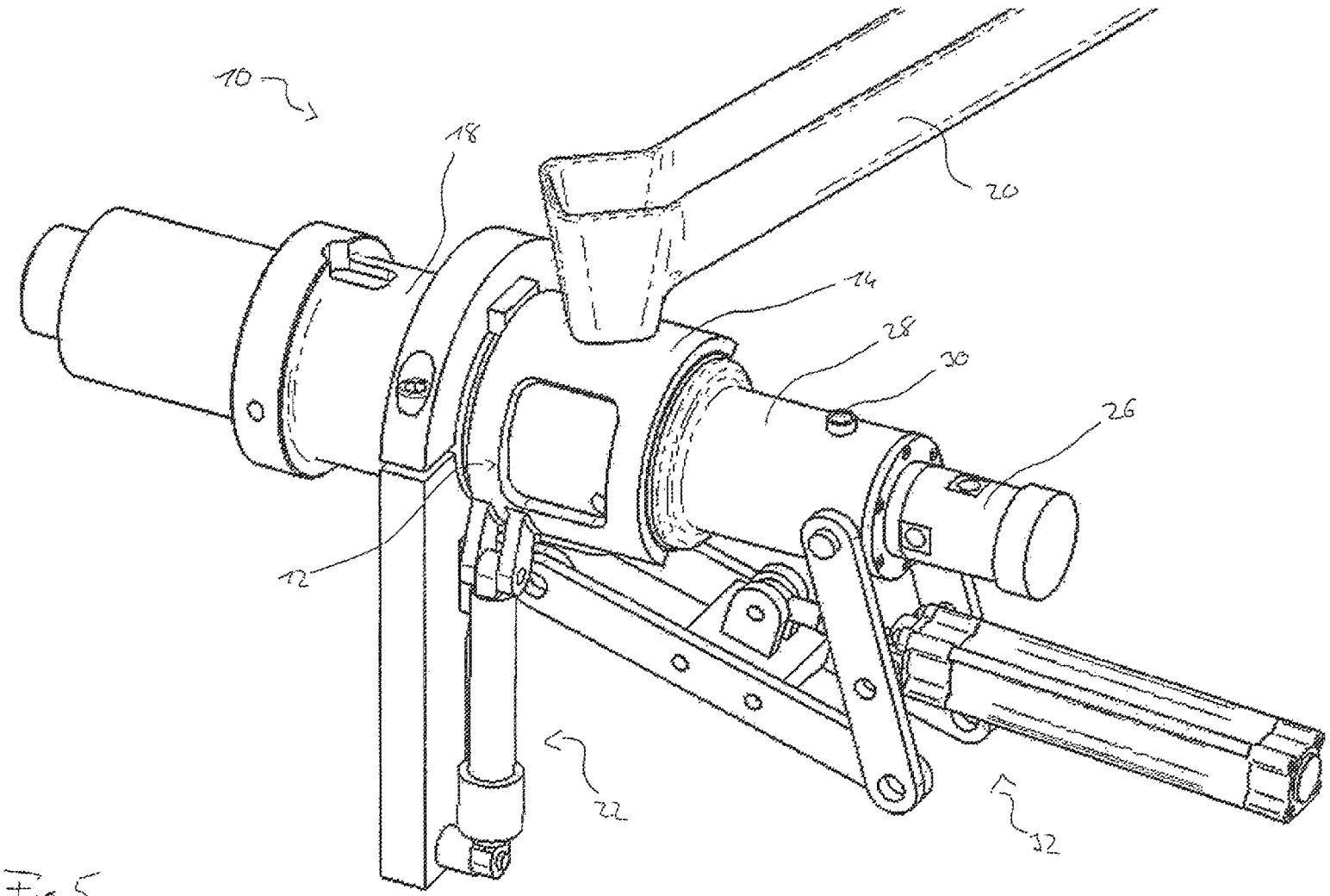

Further developments and advantageous embodiments of the invention can be evident from the following descriptions of exemplary embodiments according to the invention, which are shown in the drawing. The figures show:

FIG. 1 a casting apparatus according to the invention in a filling position, FIG. 2 a casting apparatus according to the invention in a pre-casting position, FIG. 3 a casting apparatus according to the invention in a casting position, FIG. 4 a casting apparatus according to the invention having an exhaust opening disposed on the sleeve, which opening is situated in a state of the sleeve between the filling position and the casting position, and FIG. 5 a casting apparatus according to the invention in a post-casting position.

When the same reference numbers are used in FIG. 1 to 5, these refer to the same parts, so that for the purpose of avoiding repetition, a component that has already been described does not have to be discussed again in every figure description.

FIG. 1 shows a casting apparatus 10 according to the invention in the filling position. In this position, the filling opening 12 of the sleeve 14 is disposed above the filling opening 16 of the casting chamber 18, at least in part. A feed line 20, particularly a casting channel, is disposed above or in the filling openings 12, 16, which cover one another, at least in part, in such a manner that the casting chamber 18 can be filled with casting material. A hydraulic rotation apparatus 22 is disposed on the side of the sleeve, which apparatus makes it possible to rotate the sleeve 14 about the longitudinal axis of the casting chamber 18. In the filling state, the casting piston 24 and the casting piston rod 26 are disposed outside of the casting chamber 13, to the greatest possible extent. In the back space of the casting chamber 18, a closure element 28, which is tube-shaped, to the greatest possible extent, is disposed around the casting piston rod 26. The closure element 28 has an exhaust opening 30, by way of which the space that is configured by the back side of the casting chamber 18, the inside of the closure element 28, and the surface of the casting piston 26 can be evacuated. In this regard, the closure element 28 is mounted so that it can be displaced along the longitudinal axis of the casting chamber 18. Displacement of the closure element along the longitudinal axis of the casting chamber 18 takes place by means of a hydraulic pushing apparatus 32.

FIG. 2 shows the casting apparatus 10 according to the invention in a pre-casting position. In this position, in comparison with FIG. 1, the closure element 28 has moved to the back side of the casting chamber 18 by means of the hydraulic pushing apparatus 32. In this regard, the closure element 28 covers the casting piston 24 completely, without the casting piston 24 already being moved into the casting chamber 18. In this state, evacuation of the space spanned by the back side of the casting chamber 18, the surface of the casting piston 24 or the casting piston rod 26, and the inside of the closure element 28, by way of the exhaust opening 30, already begins.

FIG. 3 shows the casting apparatus 10 according to the invention in a casting position. In this state, in comparison with FIG. 2, the closure element 28 has been moved to the back side of the casting chamber 18 by means of the hydraulic pushing element 32, and the sleeve 14 has been brought, into a casting position by means of the hydraulic rotation apparatus 22. In this casting position of the sleeve 14, the sleeve 14 is rotated, about the longitudinal axis of the casting chamber 18 in such a manner that the filling opening 12 of the sleeve 14 is no longer disposed to cover the filling opening 16 of the casting chamber 18, and thereby the wall of the sleeve 14 closes off completely the filling opening 16 of the casting chamber 18. Furthermore, the feed line 20, particularly the casting channel, has been moved out of the filling openings 12, 16, which were previously disposed to cover one another, at least in part, in such a manner that rotation of the sleeve 14 about the longitudinal axis of the casting chamber 18 is made possible. The exhaust opening 34 (not visible) of the sleeve is disposed above the filling opening 16 of the casting chamber 18, at least in part, by means of the rotation of the sleeve 14 about the longitudinal axis of the casting chamber 18.

FIG. 4 shows the casting apparatus 10 according to the invention in a casting position from the view of the viewing direction B (see FIG. 3). From this viewing direction B, the exhaust opening 34 of the sleeve 14, which opening is disposed above the filling opening 16 of the casting chamber 18, at least in part, can be seen.

FIG. 5 shows a casting apparatus 10 according to the invention in a post-casting position. In this state, in comparison with FIG. 3, the actual casting procedure has been completed and the casting material is introduced into the casting mold by means of the casting piston 24, which was driven by way of the casting piston rod 26.

REFERENCE SYMBOL LIST (is part of the Specification)
10 casting apparatus
12 filling opening of the sleeve
14 sleeve
16 filling opening of the casting chamber
18 casting chamber
20 feed line
22 rotation apparatus
24 casting piston
26 casting piston rod
28 closure element
30 exhaust opening of the closure element
32 pushing apparatus
34 exhaust opening of the sleeve
B viewing direction

The invention claimed is:

1. Casting apparatus (10)

comprising a casting chamber (18) having a filling opening (16), a casting piston (24) that can be moved in the casting chamber (18), which piston is connected with a casting drive, by way of a casting piston rod (26), and having a feed line (20), by way of which casting material can be filled into the casting chamber (18) through the filling opening (16), wherein the casting chamber (18) is disposed, at least in part, in a sleeve (14) that is mounted so as to rotate;

wherein the sleeve (14) has an opening (12), wherein this opening (12) can be positioned over the filling opening (16) of the casting chamber (18), at least in part, by means of a rotation of the sleeve (14) for filling the casting chamber (18) with casting material;

wherein the sleeve (14) has an exhaust opening (34); and wherein the exhaust opening (34) is spaced apart from the opening (12) of the sleeve (14) and disposed on the sleeve (14) in such a manner that the opening can be positioned above the filling opening (16) of the casting chamber (18), at least in part, by means of a rotation of the sleeve (14).

2. Casting apparatus (10), according to claim 1, wherein the sleeve (14) can be rotated about the longitudinal axis of the casting chamber (18) by means of a rotation apparatus (22).

3. Casting apparatus (10), according to claim 1, which is for a die-casting method.

4. Casting apparatus (10), according to claim 1, which is for a vacuum die-casting method.

5. Casting apparatus (10) comprising a casting chamber (18) having a filling opening (16), a casting piston (24) that can be moved in the casting chamber (18), which piston is connected with a casting drive, by way of a casting piston rod (26), and having a feed line (20), by way of which casting material can be filled into the casting chamber (18) through the filling opening (16), wherein the casting chamber (18) is disposed, at least in part, in a sleeve (14) that is mounted so as to rotate;

wherein the sleeve (14) has an opening (12), wherein this opening (12) can be positioned over the filling opening (16) of the casting chamber (18), at least in part, by means of a rotation of the sleeve (14) for filling the casting chamber (18) with casting material;

wherein the sleeve (14) and/or the feed line (20) is/are configured in such a manner that they stand in an active connection with one another; and wherein the active connection is such that when the sleeve (14) is rotated, both the sleeve (14) and the feed line (20) can be moved out of a and/or into the filling position, in such a manner that the feed line (20) can be mechanically lifted out of the opening (12) or filling opening (16) or lowered into the opening (12) or filling opening (16), at least in part, when the sleeve (14) is rotated; and wherein the sleeve and feed line at least partly slide on one another.

6. Casting apparatus (10), according to claim 5, which is for a die-casting method.

7. Casting apparatus (10), according to claim 5, which is for a vacuum die-casting method.

8. Casting apparatus (10), comprising a casting chamber (18) having a filling opening (16), a casting piston (24) that can be moved in the casting chamber (18), which piston is connected with a casting drive, by way of a casting piston rod (26), and having a feed line (20), by way of which casting material can be filled into the casting chamber (18) through the filling opening (16), wherein the casting chamber (18) is disposed, at least in part, in a sleeve (14) that is mounted so as to rotate;

wherein the casting piston rod (26) is disposed, at least in part, in a closure element (28) that is ring-shaped, to the greatest possible extent, which closure element (28) is mounted so as to be displaceable along the longitudinal axis of the casting chamber (18); and wherein the closure element (28) has an exhaust apparatus.

9. Casting apparatus (10), according to claim 8, wherein the closure element (28) can be disposed on the back side of the casting chamber (18) by means of a pushing apparatus (32).

10. Casting apparatus (10) according to claim 8, which is for a die-casting method.

11. Casting apparatus (10) according to claim 8, which is for a vacuum die-casting method.

* * * * *